US009939789B2

(12) United States Patent
Morohoshi et al.

(10) Patent No.: US 9,939,789 B2
(45) Date of Patent: Apr. 10, 2018

(54) COMMUNICATION APPARATUS, ELECTRONIC TIMEPIECE, COMMUNICATION METHOD AND RECORDING MEDIUM

(71) Applicant: CASIO COMPUTER CO., LTD., Tokyo (JP)

(72) Inventors: Hiroshi Morohoshi, Tokorozawa (JP); Hirohisa Maruyama, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/381,871

(22) Filed: Dec. 16, 2016

(65) Prior Publication Data

US 2017/0255170 A1 Sep. 7, 2017

(30) Foreign Application Priority Data

Mar. 1, 2016 (JP) ..... 2016-039107

(51) Int. Cl.
*G04R 20/14* (2013.01)
*G04G 5/00* (2013.01)

(52) U.S. Cl.
CPC ..... *G04R 20/14* (2013.01); *G04G 5/00* (2013.01)

(58) Field of Classification Search
CPC ..... G04R 20/00; G04R 20/14; G04R 20/18; G04G 5/00; G04G 5/0002; G04G 7/00; G04G 7/02
See application file for complete search history.

(56) References Cited

U.S. PATENT DOCUMENTS 5,089,814 A * 2/1992 DeLuca ..... G08B 3/1083 340/7.27
5,408,444 A * 4/1995 Kita ..... G04G 9/0076 368/47
8,009,519 B2 * 8/2011 Jazra ..... G01S 19/25 368/46
8,077,550 B2 * 12/2011 Akiyama ..... G04R 20/06 368/21
9,253,744 B2 * 2/2016 Unsicker ..... H04W 56/00
2005/0232086 A1 * 10/2005 Jiddou ..... G04G 9/0076 368/47

(Continued)

FOREIGN PATENT DOCUMENTS

JP 2009-118403 A 5/2009

*Primary Examiner* — Vit W Miska
(74) *Attorney, Agent, or Firm* — Scully, Scott, Murphy & Presser, P.C.

(57) ABSTRACT

A communication apparatus comprises a communicator that receives a standard time from an external apparatus, a manipulation receiver that receives a time correction action from a user, and a controller that performs a timing processing for clocking time and a time correction processing for correcting the time clocked by the timing processing, on the basis of the standard time received by the communicator, or on the basis of the time correction action received by the manipulation receiver. The controller changes processing contents of the time correction processing until a prescribed time interval has elapsed, when the time clocked by the timing processing is corrected on the basis of the time correction action received by the manipulation receiver.

20 Claims, 15 Drawing Sheets

(56) References Cited

U.S. PATENT DOCUMENTS

| | | | | |
|---|---|---|---|---|
| 2006/0251127 | A1* | 11/2006 | Ishida | G04R 20/14<br>370/503 |
| 2009/0271110 | A1* | 10/2009 | Sugiura | G01C 21/005<br>701/532 |
| 2014/0302876 | A1* | 10/2014 | Oizumi | G04R 20/14<br>455/456.3 |
| 2016/0246264 | A1* | 8/2016 | Nagareda | G04R 20/26 |

* cited by examiner

COMMUNICATION APPARATUS, ELECTRONIC TIMEPIECE, COMMUNICATION METHOD AND RECORDING MEDIUM

CROSS-REFERENCE TO RELATED APPLICATION

This application claims the benefit of Japanese Patent Application No. 2016-039107, filed on Mar. 1, 2016, the entire disclosure of which is incorporated by reference herein.

FIELD

This application relates generally to a communication apparatus, electronic timepiece, communication method and recording medium.

BACKGROUND

Electronic timepieces possessing functions that connect to mobile phones such as smartphones, feature phones and/or the like through short-range wireless communication and automatically correct the time have been known from before. For example, Patent Literature 1, Unexamined Japanese Patent Application Kokai Publication No. 2009-118403, discloses a time correction system, mobile phone apparatus and wristwatch-type mobile terminal that connects a mobile phone and a wristwatch-type terminal by means of Bluetooth® and synchronizes the time on the wristwatch-type terminal based on the time on the mobile phone. In addition, more recently electronic timepieces have begun to appear that automatically correct time using Bluetooth® Low Energy (BLE) instead of Bluetooth®. Such electronic timepieces tend to increase the frequency of automatic time corrections so that when a wearer arrives at a foreign destination by airplane, the local time is immediately displayed.

For example, the wristwatch-type terminal disclosed in Patent Literature 1 is one kind of electronic timepiece that corrects time based on the time on a mobile phone. Accordingly, even if the users manually corrects the time on the wristwatch-type terminal to the time at the destination location while in an airplane flying abroad, when subsequently the time is automatically corrected on the basis of the time on the mobile phone, the time on the timepiece of the wristwatch-type terminal returns from the time of the destination location to the time of the departure location, which is the time on the timepiece of the mobile phone.

SUMMARY

In consideration of the foregoing, an exemplary object of the present disclosure is to provide a communication apparatus, electronic timepiece, communication method and recording medium for correcting time more suitably to a user.

In order to achieve the above exemplary object, a communication apparatus according to the present disclosure includes:

a communicator that receives a standard time from an external apparatus;

a manipulation receiver that receives a time correction action from a user; and a controller that performs a timing processing for clocking time, and a time correction processing for correcting time clocked by the timing processing, on the basis of the standard time received by the communicator, or on the basis of the time correction action received by the manipulation receiver;

wherein the controller changes processing contents of the time correction processing until a prescribed time interval has elapsed, when the time clocked by the timing processing was corrected on the basis of the time correction action received by the manipulation receiver.

BRIEF DESCRIPTION OF THE DRAWINGS

A more complete understanding of this application can be obtained when the following detailed description is considered in conjunction with the following drawings, in which.

DETAILED DESCRIPTION

Figure 1:
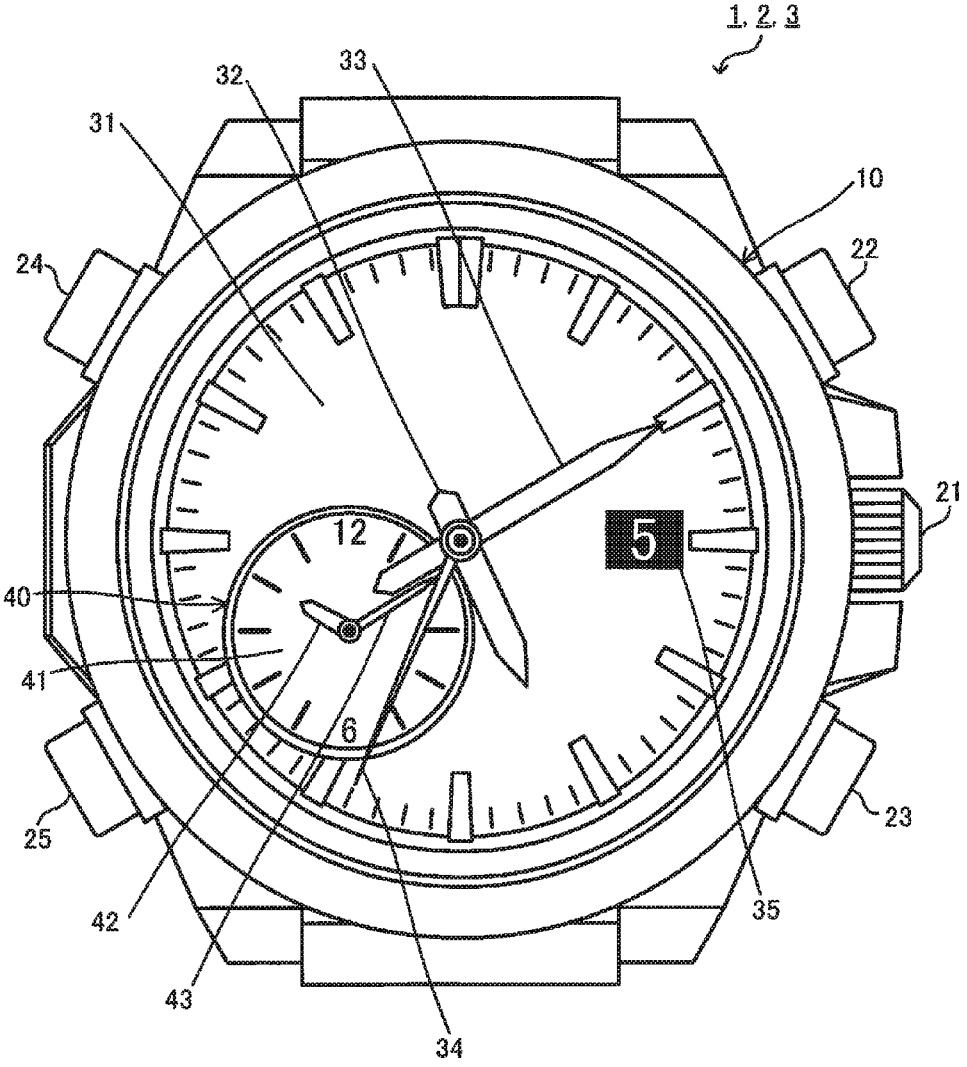
FIG. 1 an external view of an electronic timepiece 1, 2, 3 according to exemplary embodiments of the present disclosure.

Below, exemplary embodiments of the present disclosure are described in detail with reference to the drawings. Same or corresponding parts in the drawings are labeled with the same reference symbols.

First Exemplary Embodiment

FIG. 1 is an external view of an electronic timepiece 1 (communication apparatus) according to a first exemplary embodiment of the present disclosure. The electronic timepiece 1 comprises a case 10 on the top surface of which a crystal is configured, and a crown 21 and push-button switches 22-25, disposed on a side surface of the case 10. In addition, inside the case 10, a face 31, various hands (hour hand 32, minute hand 33, second hand 34) and a date dial 35 are provided so as to be visible through the crystal. The face 31 is provided with markings and gradations to indicate the time. The various hands (hour hand 32, minute hand 33, second hand 34) rotate on the face 31 to display the current time. The date dial 35 displays the current date. In the description below, the time indicated by the hands (hour hand 32, minute hand 33, second hand 34) is also notated as the home time.

In addition, a small timepiece 40 is provided in the eight o'clock direction on the face 31. The small timepiece 40 comprises a face 41 and various hands (hour hand 42, minute hand 43). The various hands (hour hand 42, minute hand 43) rotate on the face 41 and can display a time differing from the home time. In the description below, the time indicated by the hands (hour hand 42, minute hand 43) of the small timepiece 40 is also notated as the dual time.

The crown 21 and the push-button switches 22-25 each receive input manipulation from the user. The crown 21 can be pulled out in two stages from the case 10, and by rotationally manipulating the crown 21 in the two pulled-out stages, the user can manually correct the time difference between the home time and Coordinated Universal Time (UTC). The push-button switches 22-25 are manipulated when changing the correction mode, switching to or from daylight saving time, switching the home time and the dual time, connecting to an external communication apparatus, and/or the like.

Figure 2:
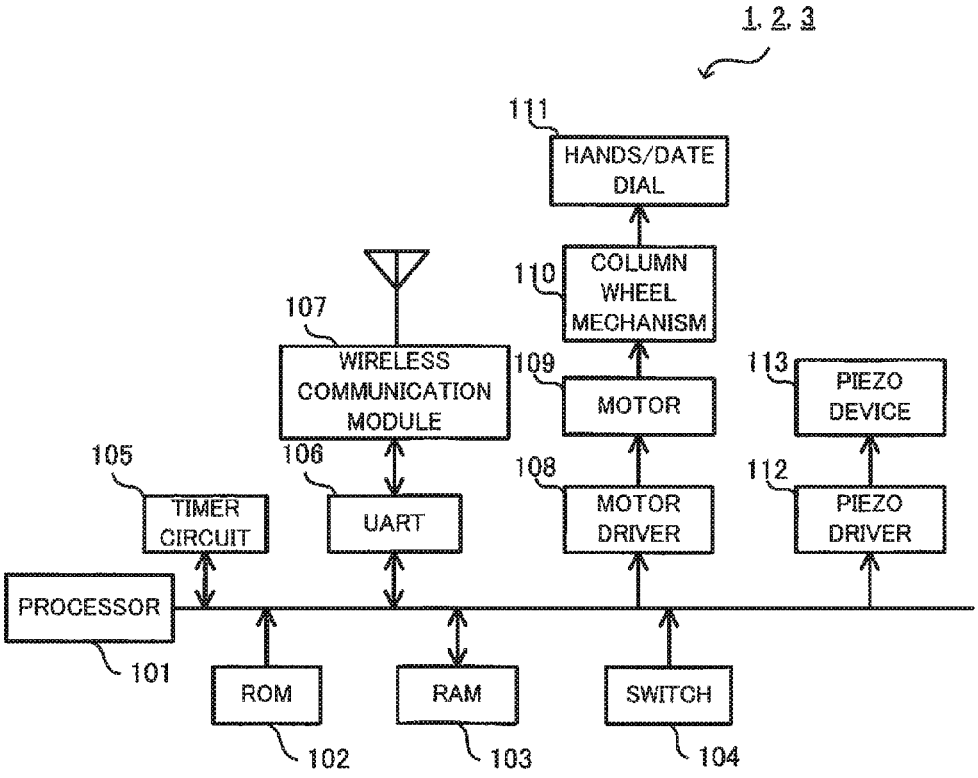
FIG. 2 is a block diagram showing a hardware configuration of the electronic timepiece 1, 2, 3 according to the exemplary embodiments.

Next, a hardware configuration of the electronic timepiece 1 is described. As shown in FIG. 2, the electronic timepiece 1 comprises a processor 101, a read-only memory (ROM) 102, a random access memory (RAM) 103, a switch 104, a timer circuit 105, a universal Asynchronous Receiver Transmitter (UART) 106, a wireless communication module 107, a motor driver 108, a motor 109, a column wheel mechanism 110, a hands/date dial 111, a piezo driver 112 and a piezo device 113.

The processor 101 comprehensively controls the entirety of the electronic timepiece 1 by executing various types of control programs. In the ROM 102, the control programs executed by the processor 101 and various types of data necessary for executing the control programs are stored in advance. The RAM 103 stores various types of data created or changed during execution of the control programs, and functions as a work space for the processor 101 to work.

The switch 104 receives input manipulation from the user and outputs to the processor 101 electric signals corresponding to the input manipulation. The above-described crown 21 and push-button switches 22-25 are included in the switch 104.

The timer circuit 105 comprises a quartz oscillator, a clock division circuit and/or the like, clocks the current date and time by figuring the number of signals obtained from the clock division circuit, and outputs the clocked results to the processor 101.

The UART 106 mutually converts parallel signals handled by the processor 101 and serial signals handled by the wireless communication module 107. The wireless communication module 107 comprises a BLE module and an antenna, and performs data communication with an external communication apparatus such as a smartphone and/or the like. A below-described automatic time correction processing is performed via the wireless communication module 107.

The motor driver 108 outputs a drive pulse signal to the motor 109, on the basis of instructions from the processor 101. The motor 109 is a stepping motor, and causes the column wheel mechanism 110 to be driven in accordance with the drive pulse input from the motor driver 108. The motor 109 may also comprise a motor other than a stepping motor.

The column wheel mechanism 110 is comprised of a combination of a plurality of gears. The column wheel mechanism 110 causes the hands/date dial 111 to rotate a specific angle at a time in accordance with the rotational action of the motor 109. Typically, the motor 109, the column wheel mechanism 110 and the hands/date dial 111 are provided in plurality in each of the types of hands and the date dial.

For example, each time the processor 101 causes the motor 109 for the hour hand to rotate once in two minutes, the hour hand of the hands/date dial 111 rotates one degree by means of the column wheel mechanism 110 for the hour hand.

In addition, each time the processor 101 causes the motor 109 for the minute hand to rotate once a second, the second hand of the hands/date dial 111 rotates six degrees and the minute hand rotates 1/10 degree by means of the column wheel mechanism 110 for the minute hand.

In addition, each time the processor 101 causes the motor 109 for the dual time to rotate once in 60 seconds, the minute hand of the hands/date dial 111 for the small timepiece 40 rotates six degrees and the hour hand rotates ½ degree by means of the column wheel mechanism 110 for dual time.

The piezo driver 112 outputs a driver signal to the piezo device 113 on the basis of instructions from the processor 101. The piezo device 113 is a piezoelectric device, oscillates in accordance with the driver signal input from the piezo driver 112 and causes a sound to be produced.

Here, the electronic timepiece 1 will be described as an analog timepiece the hands and date dial of which move mechanically. However, the electronic timepiece 1 may also be a digital timepiece in which the date and time are displayed on a display screen comprising a display device such as a liquid crystal, an organic electro-luminescence (EL) display and/or the like. For example, in the case of a digital timepiece having an liquid crystal screen, the timepiece comprises an liquid crystal driver and a liquid crystal display device instead of the motor driver 108, the motor 109, the column wheel mechanism 110 and the hands/date display 111, and the processor 101 causes the current time to be displayed on the liquid crystal display device by means of the liquid crystal driver.

Figure 3:
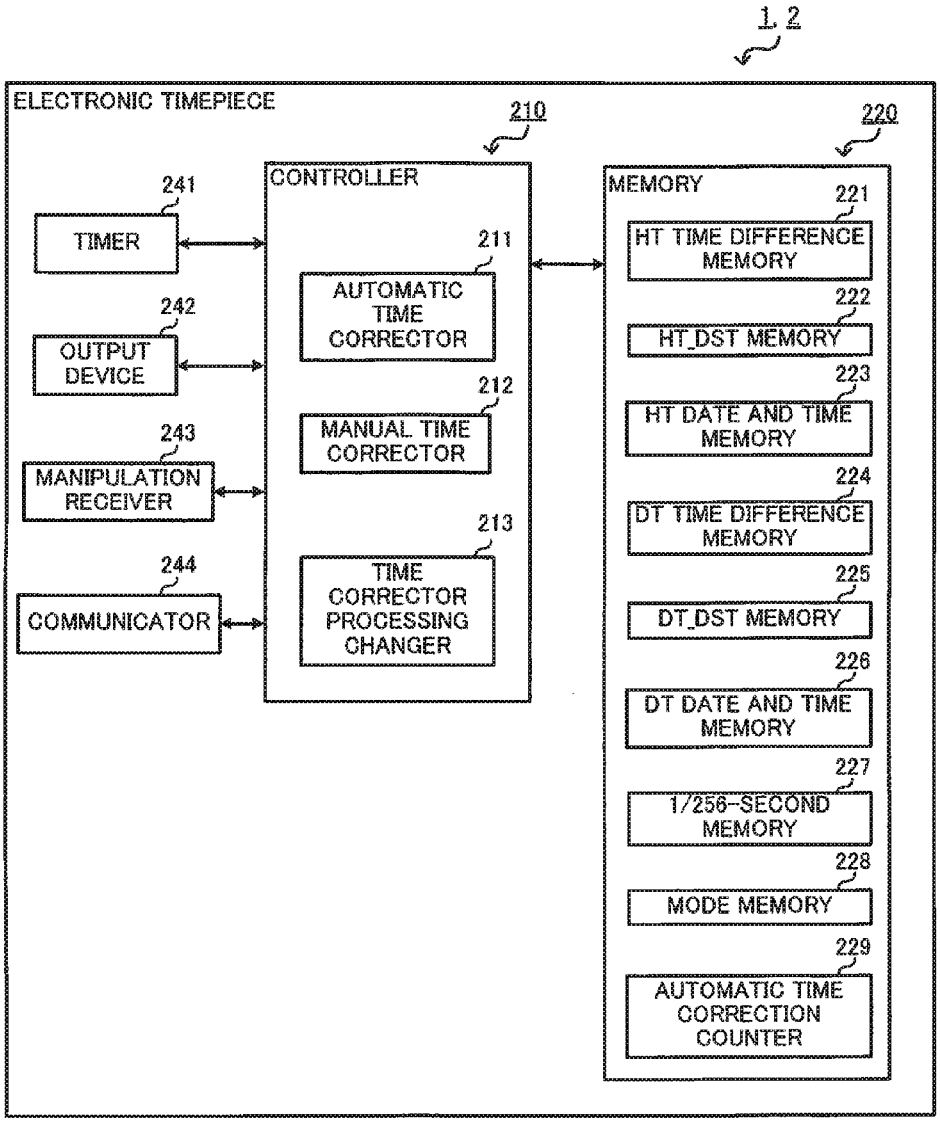
FIG. 3 is a block diagram showing a functional configuration of the electronic timepiece 1, 2 according to the exemplary embodiments.

Next, the functional configuration of the electronic timepiece 1 will be described. As shown in FIG. 3, the electronic timepiece 1 comprises a controller 210, a memory 220, a timer 241, an output device 242, a manipulation receiver 243 and a communicator 244.

The controller 210 comprises the processor 101 such as a central processing unit (CPU) and/or the like, and realizes functions of various parts of the electronic timepiece 1 (automatic time corrector 211, manual time corrector 212, time correction processing changer 213) by executing programs stored in the memory 220. The functions of the automatic time corrector 211, manual time corrector 212 and time correction processing changer 213 may be realized through a single processor or controller 210, or the functions may be realized by independent processors and controllers 210 meaning each function may be respectively provided with a corresponding processor or controllers 210.

The automatic time corrector 211 as the controller 210 periodically communicates with an external smartphone and/or the like via the communicator 244, acquires time information that becomes a standard and corrects the time of the home time stored in the memory 220.

The manual time corrector 212 as the controller 210 corrects the time stored in the memory 220 upon receiving time correction manipulation from the user from the manipulation receiver 243.

The time correction processing changer 213 as the controller 210 corrects processing contents of the automatic time correction processing by the automatic time corrector 211 at a prescribed interval (for example 24 hours). Specifically, when an automatic time correction counter 229 is not 0, the processing contents of the automatic time correction processing are changed so that automatic time correction is not performed by the automatic time corrector 211, by causing a transmission operation for signals (for example, notification information indicating the presence of an own terminal) for starting communication that causes transmission to the communicator 244 for a prescribed interval (for example a one-hour interval) to be halted, and or the like, or only information about seconds is corrected.

The memory 220 comprises the ROM 102, the RAM 103 and/or the like. The RAM 103 comprises a home time (HT) time difference memory 221 that stores the home time's time difference (time difference between the home time and Coordinated Universal Time (UTC)), an HT_DST (daylight saving time) memory 222 that stores home time daylight saving time information, an HT date and time memory 223 that stores information about the date (year, month and day) and the time (hours, minutes and seconds) of the home time, a dual time (DT) time difference memory 224 that stores the dual time's time difference (the time difference between the dual time and Coordinated Universal Time (UTC)), a DT_DST memory 225 that stores dual time daylight saving time information, a DT date and time memory 226 that stores information about the date (year, month and day) and the time (hours, minutes and seconds) of the dual time, a 1/256-second memory 227 that stores information of less than a second in 1/256-second units and used in common by the home time and the dual time, a mode memory 228 that stores the current mode of the electronic timepiece 1 (regular mode, time correction mode, and/or the like), and the automatic time correction counter 229 that counts the time for changing the processing contents of the automatic time corrector 211 by means of the time correction processing changer 213.

The values attained by the time differences stored in the HT time difference memory 221 and the DT time difference memory 224 are in a range from −12 hours to +14 hours. The values attained by the daylight saving time information stored in the HT_DST memory 222 and the DT_DST memory 225 are 0 (standard time) or +1 hour (daylight saving time). The values stored in the HT date and time memory 223 and the DT date and time memory 226 are years, months, days, hours, minutes and seconds. The values stored in the 1/256-second memory 227 are incremented with a timing of 1/256 of a second by a below-described timing processing of the timer 241 and the controller 210. In addition, at the timing of 1/256 of a second after the value stored in the 1/256-second memory 227 becomes 255, the value stored in the 1/256-second memory 227 becomes 0, and the seconds information of the home time stored in the HT date and time memory 223 and the seconds information of the dual time stored in the DT date and time memory 226 are each incremented by 1. Furthermore, one second after the timing at which the seconds information becomes 59 seconds, the seconds information becomes 0 and the minutes information is incremented by 1. The same is true for minutes information and beyond.

The timer 241 comprises the timer circuit 105, clocks the current date and time and outputs the clocked result to the controller 210. On the basis of the clocked result input from the timer 241, the controller 210 performs a timing processing that updates the information stored in the HT date and time memory 223, the DT date and time memory 226 and the 1/256-second memory 227 of the memory 220. The function of the timer 241 may also be realized by the controller 210.

The output device 242 comprises a time display and a sound output device. The time display comprises the motor driver 108, the motor 109, the column wheel mechanism 110 and the hands/date dial 111, and displays the current time. The sound output device comprises the piezo driver 112 and the piezo device 113, and outputs manipulation sounds and alarm sounds. When the electronic timepiece 1 is a digital timepiece having a liquid crystal display, the time display comprises a liquid crystal driver and a liquid crystal display device.

The manipulation receiver 243 comprises the switch 104 that includes the crown 21 and the push-button switches 22-25, and receives manipulations from the user.

The communicator 244 comprises the wireless communication module 107, and performs data communication with an external communication apparatus such as a smartphone and/or the like. Contents of the data communication include transmitting requests for and receiving "time difference and daylight saving time information" for time correction, transmitting requests for and receiving "date and time and 1/256-second information", receiving commands for remote manipulation, and/or the like.

Figure 4:
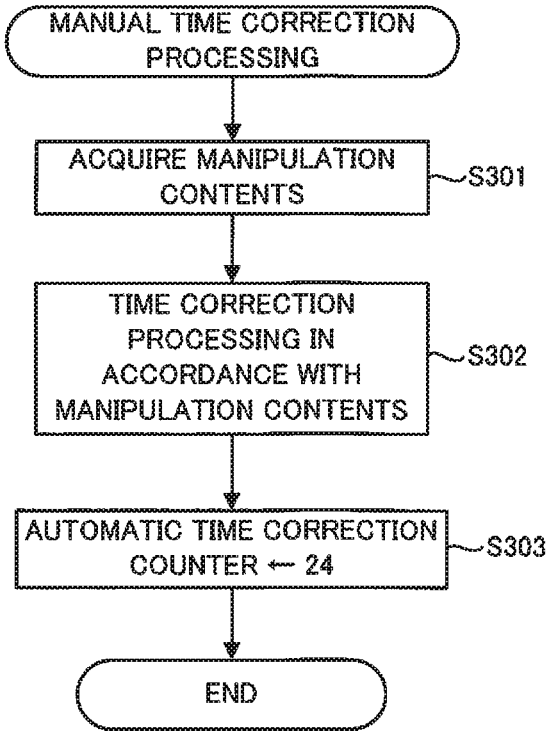
FIG. 4 is a flowchart of a manual time correction processing of the electronic timepiece 1 according to a first exemplary embodiment of the present disclosure.

Next, the manual time correction processing of the electronic timepiece 1 will be described with reference to FIG. 4. The processing is started when the crown 21 is pulled out, or when a push-button switch 22-25 is depressed, or when a time correction manipulation for the home time or a home time and dual time switching manipulation is started, by the user. The processing is a processing for setting the prescribed time interval (24 hours in the exemplary embodiment; the prescribed time interval is hereinafter referred to as the "time correction processing change time") to 24 in the automatic time correction counter 229 to ensure that automatic time correction is not performed, after manipulation such as time correction of the home time and/or the like is performed manually.

First, the controller 210 acquires the user's manipulation contents received by the manipulation receiver 243 (step S301). Next, a time correction processing in accordance with the received manipulation contents is executed by the manual time corrector 212 (step S302). Then, the controller 210 sets the automatic time correction counter 229 to 24 (step S303) and the processing concludes.

User manipulation that is the target of the manual time correction processing is manipulation through which display of the home time is changed, specifically "home time/dual time switching," "home time daylight saving time switching", "home time's time difference correction", "home time date and time correction" and/or the like.

Figure 5:
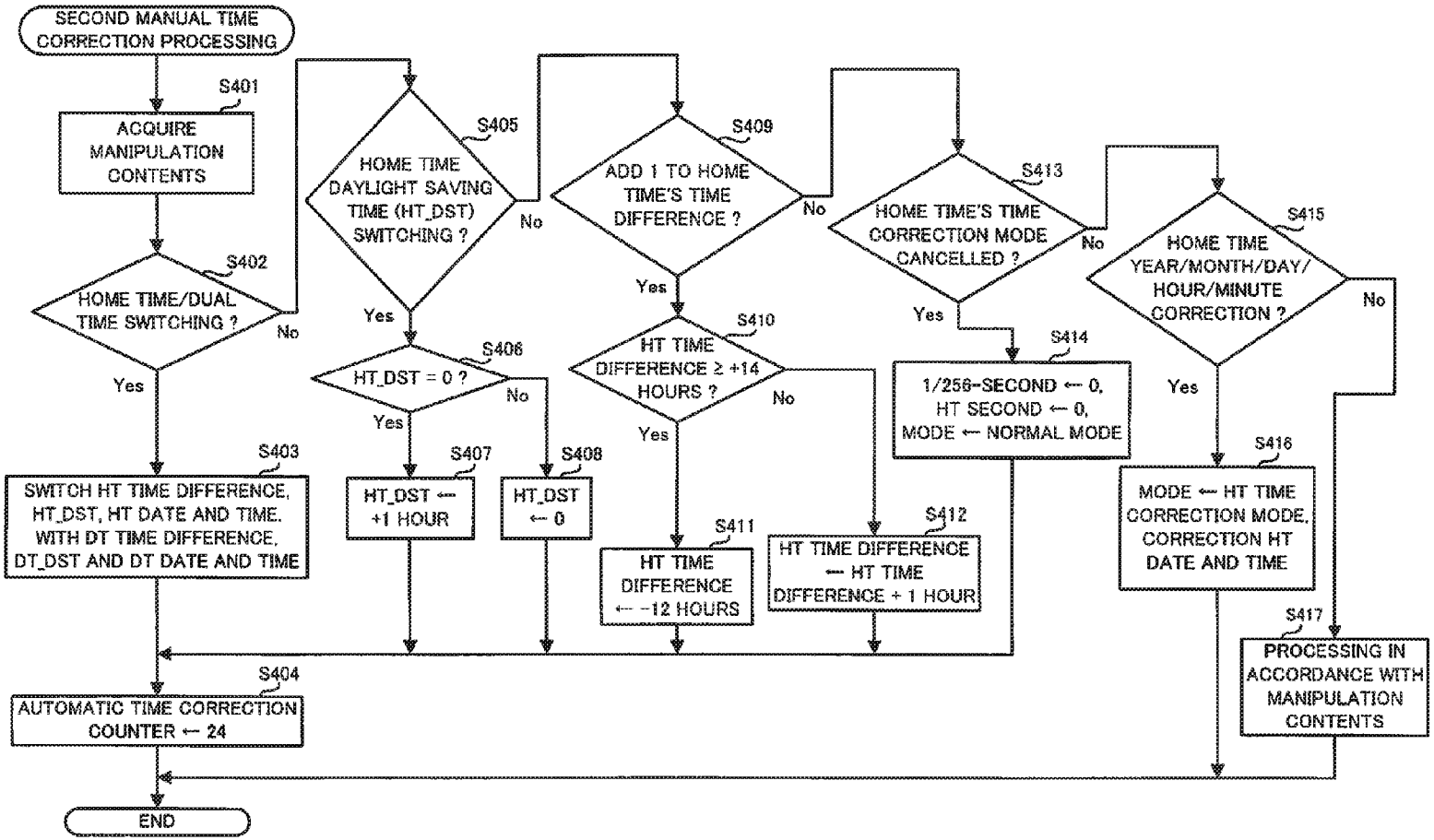
FIG. 5 is a flowchart of a second manual time correction processing of the electronic timepiece 1 according to the first exemplary embodiment.

In addition, in the manual time correction manipulation, there are changes that conclude with a single manipulation, such as "home time/dual time switching" and "home time daylight saving time switching", and there are changes like the "home time date and time correction" in which the time correction mode is entered once and then various information such as the year, month and day and the hours and minutes and/or the like are corrected, following which the time correction mode is cancelled. However, in the case of manipulations such as the latter one in which the time correction mode is entered once, the automatic time correction counter 229 may be set to 24 when the manipulation of cancelling the time correction mode is performed, rather than each time a correction manipulation is done. This second manual time correction processing is described with reference to FIG. 5.

First, the controller 210 acquires the user manipulation contents received by the manipulation receiver 243 (step S401). Next, the controller 210 determines whether or not the acquired manipulation contents are "home time/dual time switching" manipulation (step S402). If the contents are "home time/dual time switching" manipulation (step S402: Yes), the processing proceeds to step S403, and the manual time corrector 212 switches the time difference of the home time stored in the HT time difference memory 221 and the time difference of the dual time stored in the DT time difference memory 224, switches the home time daylight saving time information stored in the HT_DST memory 222 and the dual time daylight saving time information stored in the DT_DST memory 225, and switches the home time date and time information stored in the HT date and time memory 223 and the dual time date and time information stored in the DT date and time memory 226 (step S403). Then, the controller 210 sets the automatic time correction counter 229 to 24 (step S404), and concludes the processing.

When the acquired manipulation contents are not the "home time/dual time switching" manipulation (step S402: No), the controller 210 determines whether or not the acquired manipulation contents are a "home time daylight saving time switching" manipulation (step S405). When the contents are the "home time daylight saving time switching" manipulation (step S405: Yes), the controller 210 determines whether or not the home time daylight saving time information stored in the HT_DST memory 222 is 0 (step S406). If the daylight saving time information is 0 (step S406: Yes), the manual time corrector 212 sets "+1 hour" in the HT_DST memory 222 (step S407). If the daylight saving time information is not 0 (step S406: No), the manual time corrector 212 sets 0 in the HT_DST memory 222 (step S408). Then, the controller 210 sets the automatic time correction counter 229 to 24 (step S404), and concludes the processing.

If the acquired manipulation contents are not the "home time daylight saving time switching" manipulation (step S405: No), the controller 210 determines whether or not the acquired manipulation contents are a "add 1 to the home time's time difference" manipulation (step S409). If the contents are the "add 1 to the home time's time difference" manipulation (step S409: Yes), the controller 210 determines whether or not the time difference stored in the HT time difference memory 221 is at least +14 hours (step S410). If the time difference is at least +14 hours (step S410: Yes), the manual time corrector 212 sets "−12 hours" in the HT time difference memory 221 (step S411), while if the time difference is less than +14 hours (step S410: No), the manual time corrector 212 adds one hour to the time difference stored in the HT time difference memory 221 (step S412). Then, the controller 210 sets the automatic time correction counter 229 to 24 (step S404), and concludes the processing.

If the acquired manipulation contents are not the "add 1 to the home time's time difference" manipulation (step S409: No), the controller 210 determines whether or not the acquired manipulation contents are a "home time's time correction mode cancellation" manipulation (step S413). If the contents are the "home time's time correction mode cancellation" manipulation (step S413: Yes), the manual time corrector 212 sets 0 in the 1/256-second memory 227, sets 0 in the seconds information stored in the HT date and time memory 223, and sets "normal mode" in the mode memory 228 (step S414). Then, the controller 210 sets the automatic time correction counter 229 to 24 (step S404), and concludes the processing.

If the acquired manipulation contents are not the "home time's time correction mode cancellation" manipulation (step S413: No), the controller 210 determines whether or not the acquired manipulation contents are a "home time year/month/day/hour/minute correction" manipulation (step S415). If the contents are the "home time year/month/day/hour/minute correction" manipulation (step S415: Yes), the manual time corrector 212 sets "home time's time correction mode" in the mode memory 228, changes the home time date and time stored in the HT date and time memory 223 to post-correction values (step S416) and concludes.

If the acquired manipulation contents are not the "home time year/month/day/hour/minute correction" manipulation (step S415: No), a processing in accordance with the manipulation contents is performed (step S417) and then the processing concludes.

Through the second manual time correction processing above, when the time is corrected manually, the automatic time correction counter 229 is set to 24. Although such was omitted in the description above in order to avoid complication, the processing for the case of a "subtract 1 from the home time's time difference" manipulation may be added the same as the processing for the case of the "add 1 to the home time's time difference" manipulation.

Figure 6:
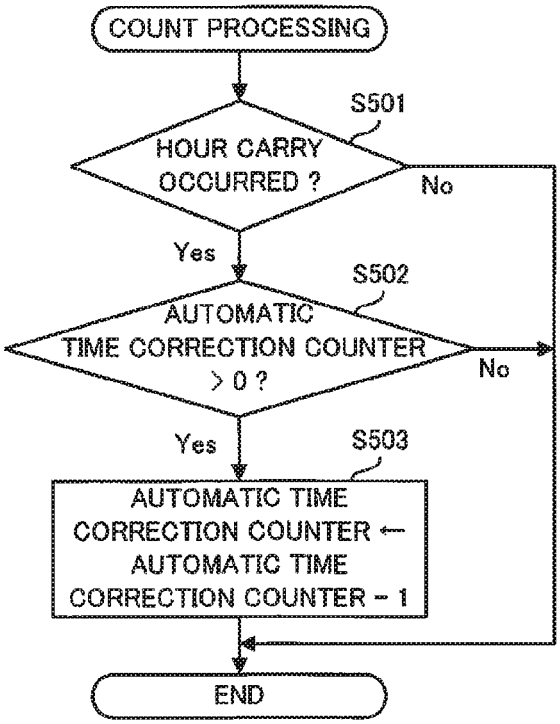
FIG. 6 is a flowchart of a count processing of the electronic timepiece 1 according to the first exemplary embodiment.

Next, a count processing for the automatic time correction counter 229 of the electronic timepiece 1 will be described with reference to FIG. 6. In order to count 24 hours using the automatic time correction counter 229, this count processing is executed when an hour carry has occurred during the timing processing of the electronic timepiece 1 (every time a new hour starts one second after the time of 59 minutes and 59 seconds).

First, the controller 210 determines whether or not an hour carry has occurred (step S501). If an hour carry has occurred (step S501: Yes), the controller 210 determines whether or not the automatic time correction counter 229 is larger than 0 (step S502). If the automatic time correction counter 229 is larger than 0 (step S502: Yes), the controller 210 reduces the value of the automatic time correction counter 229 by 1 (step S503) and then concludes the processing. When an hour carry does not occur (step S501: No) and when the automatic time correction counter 229 is 0 or less (step S502: No), the processing concludes with nothing being done.

Through this count processing, the automatic time correction counter 229 can count the time elapsed since the manual time correction processing, in one-hour units.

Figure 7:
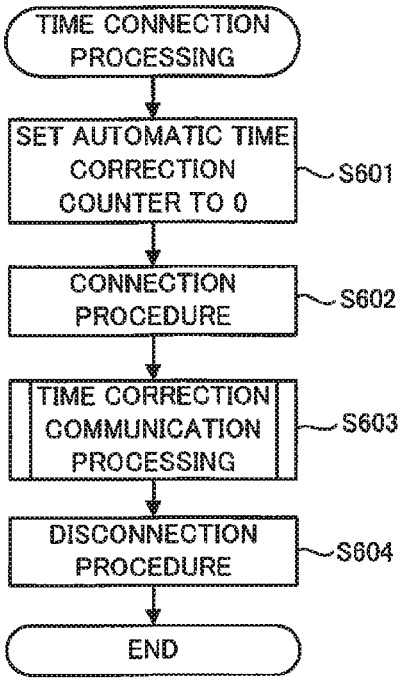
FIG. 7 is a flowchart of a time connection processing of the electronic timepiece 1 according to the first exemplary embodiment.

Next, a time connection processing of the electronic timepiece 1 will be described with reference to FIG. 7. This processing is a processing in which the electronic timepiece 1 is connected to an external communication apparatus such as smartphone and/or the like, and the time of the electronic timepiece is synchronized to the time of a timepiece possessed by the external communication apparatus. This processing is started when time connection is commanded through user manipulation. The user commanding time connection means that the intent is to synchronize the time to the timepiece possessed by the external communication apparatus, so the assumption is that at this point in time the time on the timepiece possessed by the external communication apparatus has already been made correct. Accordingly, there is no problem if the normal automatic time correction processing is performed without the need to wait for a prescribed time thereafter, so this is a processing for setting the automatic time correction counter 229 to 0.

First, the controller 210 sets the automatic time correction counter 229 to 0 (step S601). Then, the controller 210 connects to the external communication apparatus via the communicator 244 (step S602). Furthermore, the automatic time corrector 211 performs a time correction communication processing (step S603). Details of the time correction communication processing are described below. Furthermore, the controller 210 terminates the connection to the external communication apparatus via the communicator 244 (step S604) and concludes the processing.

The time correction communication processing is a processing wherein the electronic timepiece 1 acquires the time that is the standard from an external communication apparatus, and corrects the internal time of the electronic timepiece 1. However, the processing contents for time correction differ depending on whether or not the value of the automatic time correction counter 229 is 0. If the value of the automatic time correction counter 229 is 0, the time acquired from the external communication apparatus is set as the time of the electronic timepiece 1 without change, but if the value of the automatic time correction counter 229 is not 0, time correction of the electronic timepiece 1 is not performed. The time correction communication processing will be described with reference to FIG. 8.

First, the time correction processing changer 213 determines whether or not the automatic time correction counter 229 is 0 (step S701). If the automatic time correction counter 229 is not 0 (step S701: No), the processing concludes with nothing being done. That is to say, even if the automatic time correction processing is performed prior to 24 hours elapsing after the manual time correction processing, the contents of the automatic time correction processing are changed without automatic time correction of the time of the electronic timepiece 1 being performed.

If the automatic time correction counter 229 is 0 (step S701: Yes), the controller 210 requests transmission of time difference and daylight saving time information from the external communication apparatus, via the communicator 244 (step S702). The external communication apparatus, upon receiving the request, transmits the time difference and daylight saving time information of the timepiece possessed by the apparatus to the requesting apparatus. Then, the controller 210 receives the time difference and daylight saving time information transmitted by the external communication apparatus, via the communicator 244 (step S703).

Next, the controller 210 requests transmission of date and time and 1/256-second information from the external communication apparatus, via the communicator 244 (step S704). The external communication apparatus, upon receiving the request, transmits the date and time and 1/256-second information of the timepiece possessed by the apparatus to the requesting apparatus. Then, the controller 210 receives the date and time and 1/256-second information transmitted by the external communication apparatus, via the communicator 244 (step S705).

Next, the controller 210 sets the 1/256-second memory 227 to the received 1/256-second information, sets the HT date and time memory 223 to the received date and time, sets the HT_DST memory 222 to the received daylight saving time information and sets the HT time difference memory 221 to the received time difference information (step S706).

Next, the controller 210 adds the time difference stored in the DT time difference memory 224 and the daylight saving time information stored in the DT_DST memory 225 to Coordinated Universal Time (UTC) calculated by subtracting the time difference information stored in the HT time difference memory 221 and the daylight saving time information stored in the HT_DST memory 222 from the home time date and time stored in the HT date and time memory 223, finds the dual time date and time, and sets such in the DT date and time memory 226 (step S707). Then, the processing concludes.

Through the time connection processing above, the user can correct the time of the electronic timepiece 1 to the time of an external communication apparatus at an arbitrary time.

Figure 9:
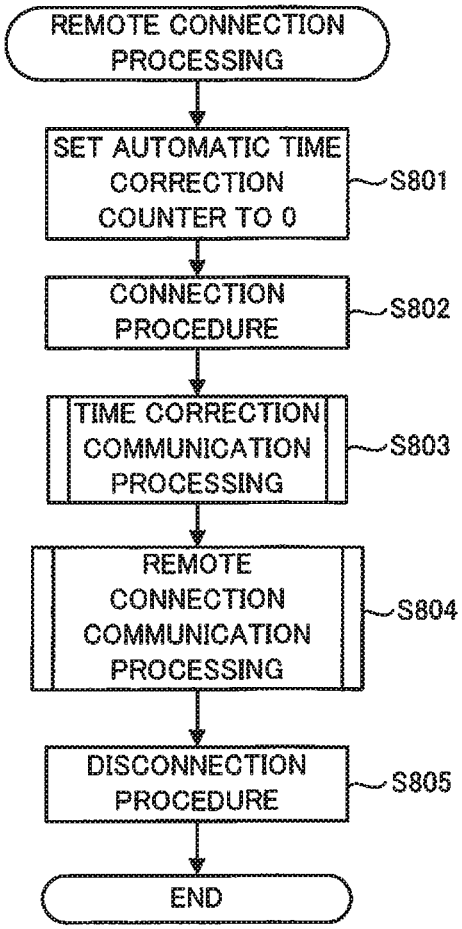
FIG. 9 is a flowchart of a remote connection processing of the electronic timepiece 1 according to the first exemplary embodiment.

Next, a remote connection processing of the electronic timepiece 1 will be described with reference to FIG. 9. This processing is a processing for connecting the electronic timepiece 1 to an external communication apparatus such as a smartphone and/or the like, and remotely manipulating the electronic timepiece 1 from the connected external communication apparatus. Similar to time connection, during remote connection a processing is performed for correcting the time of the electronic timepiece 1 to the time of a timepiece possessed by the connection external communication apparatus. The user commanding a remote connection knowing such, the assumption is that at this point in time the time on the timepiece possessed by the external communication apparatus has already been made correct. Accordingly, there is no problem if the normal automatic time correction processing is performed without the need to wait for a prescribed time thereafter, so this is a processing for setting the automatic time correction counter 229 to 0, the same as in the time connection processing.

First, the controller 210 sets the automatic time correction counter 229 to 0 (step S801). Next, the controller 210 connects to the external communication apparatus via the communicator 244 (step S802). Then, the automatic time corrector 211 performs the time correction communication processing (step S803). Next, the controller 210 performs a remote connection communication processing (step S804). Details of the remote connection communication processing are described below. Then, the controller 210 terminates the connection with the external communication apparatus via the communicator 244 (step S805) and concludes the processing.

Figure 10:
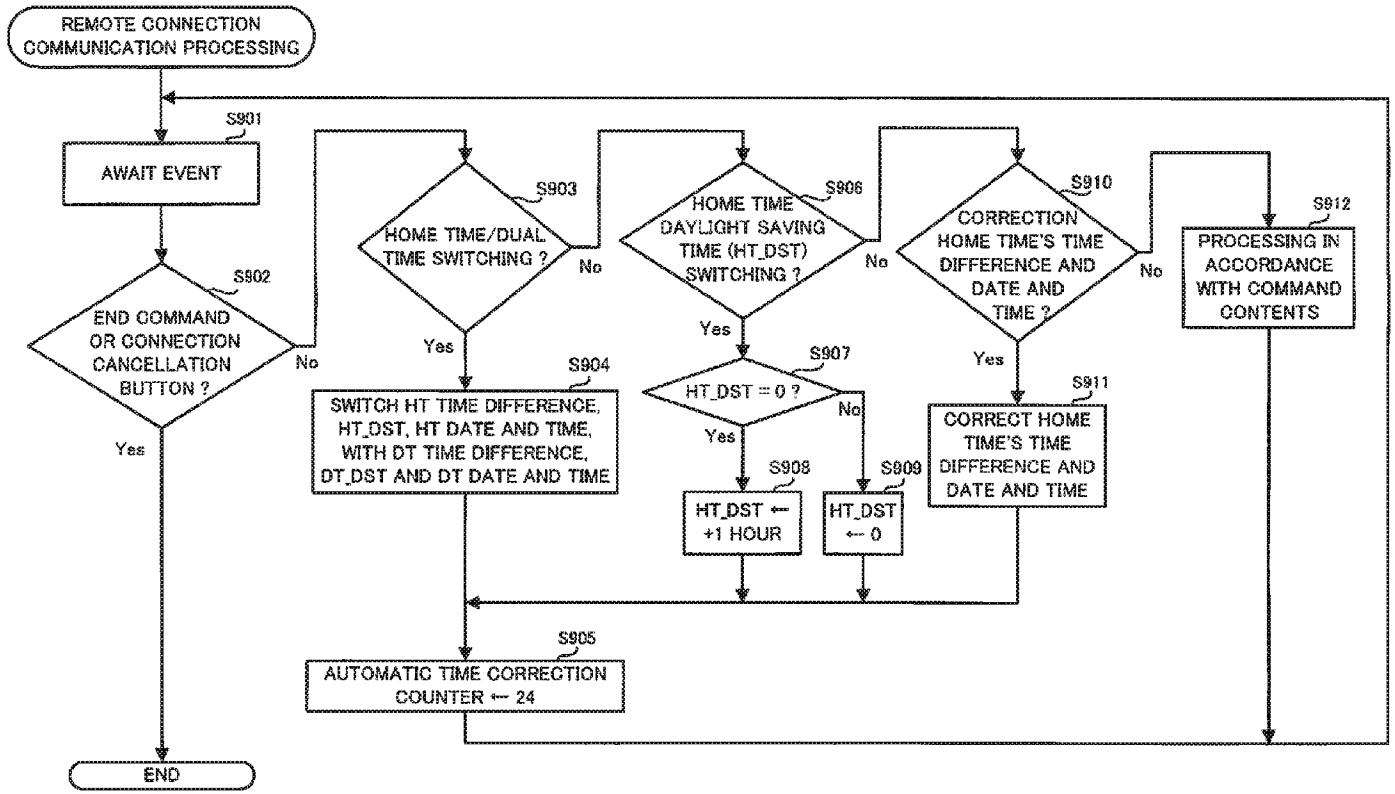
FIG. 10 is a flowchart of a remote connection communication processing of the electronic timepiece 1 according to the first exemplary embodiment.

The remote connection communication processing is a processing for receiving commands from an external communication apparatus, and executing those commands by means of the electronic timepiece 1. Various items are included in these commands, so here only a part thereof is described with reference to FIG. 10.

First, the controller 210 waits for some kind of event (step S901). Here, an event means reception of a command received from an external communication apparatus, or pushing of a push-button switch that cancels remote connection (remote connection cancellation button). When an event occurs, the controller 210 determines whether the event that occurred is a "conclude command" or a "pushing of the remote connection cancellation button" (step S902). If the event is the "conclude command" or the "pushing of the remote connection cancellation button" (step S902: Yes), the processing concludes.

If the event that occurred is not the "conclude command" or the "pushing of the remote connection cancellation button" (step S902: No), the controller 210 determines whether or not the event that occurred is a "home time/dual time switching command" (step S903).

If the event is the "home time/dual time switching command (step S903: Yes), the manual time corrector 212 switches the home time's time difference stored in the HT time difference memory 221 and the dual time's time difference stored in the DT time difference memory 224, switches the home time daylight saving time information stored in the HT_DST memory 222 and the dual time daylight saving time information stored in the DT_DST memory 225, and switches the home time date and time information stored in the HT date and time memory 223 and the dual time date and time information stored in the DT date and time memory 226 (step S904). Then, the controller 210 sets the automatic time correction counter 229 to 24 (step S905), returns to step S901 and awaits the next event.

If the event that occurred is not the "home time/dual time switching command" (step S903: No), the controller 210 determines whether or not the event that occurred is a "home time daylight saving time switching command" (step S906). If the event is the "home time daylight saving time switching command" (step S906: Yes), the controller 210 determines whether or not the home time daylight saving time information stored in the HT_DST memory 222 is 0 (step S907). If the daylight saving time information is 0 (step S907: Yes), the manual time corrector 212 sets the HT_DST memory 222 to "+1 hour" (step S908). If the daylight saving time information is not 0 (step S907: No), the manual time corrector 212 sets the HT_DST memory 222 to 0 (step S909). Then, the controller 210 sets the automatic time correction counter 229 to 24 (step S905), returns to step S901 and awaits the next event.

If the event that occurred is not the "home time daylight saving time switching command" (step S906: No), the controller 210 determines whether or not the event that occurred is a "home time's time difference and date and time correction command" (step S910). If the event is the "home time's time difference and date and time correction command" (step S910: Yes), the manual time corrector 212 performs correction of the home time's time difference and date and time in accordance with the contents of the command (step S911). Then, the controller 210 sets the automatic time correction counter 229 to 24 (step S905), returns to step S901 and awaits the next event.

If the event that occurred is not the "home time's time difference and date and time correction command (step S910: No), the controller 210 executes a processing in accordance with the command contents (step S912), returns to step S901 and awaits the next event.

Through the above remote connection processing, setting of the automatic time correction counter 229 is performed even in cases where time correction and/or the like of the home time was performed by remote connection.

In the above-described remote connection processing, the processing is undertaken under the assumption that the user knows that the processing performs correcting the time on the electronic timepiece 1 to the time of the timepiece possessed by the connected communication apparatus at the remote connection time. However, if the user makes a remote connection without knowing this, the automatic time correction processing is performed forcibly. Hence, as a variation of the remote connection processing, performing the remote connection processing omitting step S801 is conceivable.

If step S801 is not executed, the value of the automatic time correction counter 229 is preserved, so in the variation, during the 24-hour interval after the manual time correction processing is performed, automatic time correction is not done even if the remote connection processing is performed. Accordingly, even when used by a user unaware that at the remote connection time the time of the electronic timepiece 1 will be corrected to the time of the connected communication apparatus, a forcible automatic time correction processing can be prevented.

Figure 11:
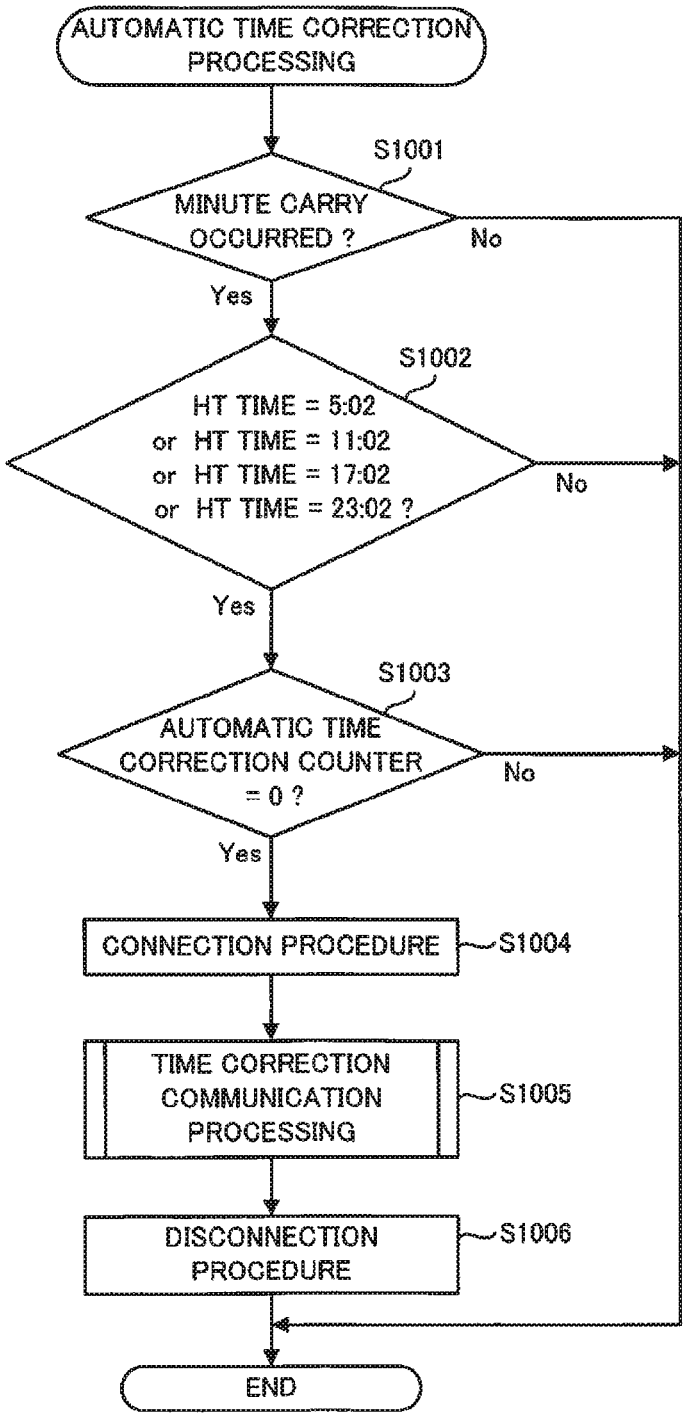
FIG. 11 is a flowchart of an automatic time correction processing of the electronic timepiece 1 according to the first exemplary embodiment.

Next, an automatic time correction processing of the electronic timepiece 1 will be described with reference to FIG. 11. This processing is a processing for periodically connecting to an external communication apparatus and automatically synching the time of the electronic timepiece 1 to the time of a timepiece possessed by the external communication apparatus.

First, the automatic time corrector 211 determines whether or not a minute carry (carrying of a minute that occurs one second after 59 seconds each minute) has occurred (step S1001). If the minute carry has occurred (step S1001: Yes), the automatic time corrector 211 determines whether or not the time (hours and minutes) of the home time stored in the HT date and time memory 223 is 5:02, 11:02, 17:02 or 23:02 (step S1002). If the time is any of these times (step S1002: Yes), the automatic time corrector 211 determines whether or not the automatic time correction counter 229 is 0 (step S1003).

If the automatic time correction counter 229 is 0 (step S1003: Yes), the automatic time corrector 211 executes a connection procedure to the external communication apparatus via the communicator 244 (step S1004). Then, the above-described time correction communication processing is executed (step S1005), following which the automatic time corrector 211 executes a disconnection procedure to the external communication apparatus via the communicator 244 (step S1006) and concludes the processing.

When the minute carry has not occurred (step S1001: No), when the time (hours and minutes) of the home time stored in the HT date and time memory 223 is not any of 5:02, 11:02, 17:02 or 23:02 (step S1002: No), and when the automatic time correction counter 229 is not 0 (step S1003: No), the processing concludes with nothing being done.

Through the automatic time correction processing above, the time of the electronic timepiece 1 is periodically corrected to the time of the external communication apparatus but while the automatic time correction counter 229 is not 0, the correction processing is not performed. Accordingly, during the 24-hour interval after the time of the electronic timepiece 1 is corrected manually, the automatic time correction processing is not performed. Accordingly, after the electronic timepiece 1 is manually corrected to the time of the destination location aboard an airplane, the time of the electronic timepiece 1 can be prevented from returning to the time of the departure location through automatic time correction.

Here, the timing of automatic time correction is set to the timing of 5:02, 11:02, 17:02 and 23:02 each day, but the timing can be set to an arbitrary timing, such as 23 minutes after every hour, or 5:11 each day, and/or the like. However, because the electronic timepiece 1 often has many processing such as time information processing and/or the like with the time of 00 minutes each hour, avoiding a timing of 00 minutes each hour for the timing of automatic time correction is preferable. In addition, the explanation was for a case in which the interval during which automatic time correction was not performed following the time of the electronic timepiece 1 being corrected manually (the time correction processing change interval) was 24 hours, but this interval can be changed to an arbitrary interval.

In addition, the electronic timepiece 1 stores the time difference and daylight saving time information, but a variation of the first exemplary embodiment can be realized if an electronic timepiece without this information omits the time difference and daylight saving time information processing. However, in this variation, because a memory for storing the time difference between the home time and the dual time is not present, in order to synch to the time of the dual time, adding the received time to a value found by subtracting the date and time of the dual time from the date and time of the home time is necessary.

Figure 8:
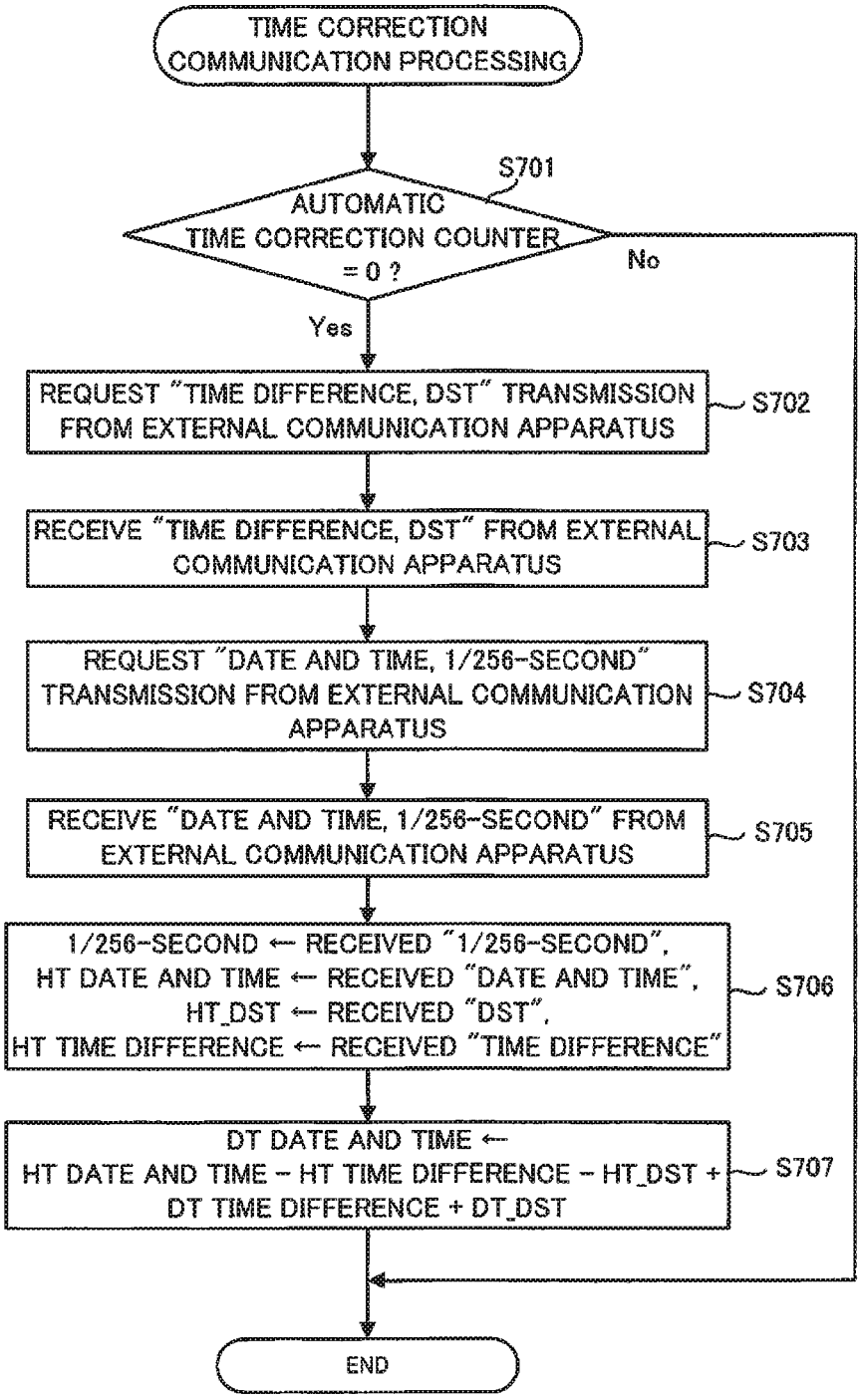
FIG. 8 is a flowchart of a time correction communication processing of the electronic timepiece 1 according to the first exemplary embodiment.

Specifically, in the time correction communication processing shown in FIG. 8, step S702 and step S703 may be omitted, step S706 may be changed to "the controller 210 sets in the DT date and time memory 226 a value found by subtracting the home time date and time stored in the HT date and time memory 223 from the dual time date and time stored in the DT date and time memory 226, and then adding the received date and time", and step S707 may be changed to "the controller 210 sets the received 1/256-second information in the 1/256-second memory 227 and sets the received date and time in the HT date and time memory 223".

Second Exemplary Embodiment

In the above-described first exemplary embodiment, time correction using the timepiece of an external communication apparatus was not performed during the 24 hours after the electronic timepiece 1 underwent time correction manually. However, one cause of the time returning to that of the departure location through the automatic time correction function despite synching to the time of the destination location while in transit aboard an airplane is that information about the time difference and daylight saving time stored by the electronic timepiece 1 is lost. If this information is not changed, the time provided by the external communication apparatus can be effectively utilized up to units of seconds. Hence, a second exemplary embodiment will be described in which the prescribed interval after manual time correction is not an interval during which automatic time correction is absolutely not performed but rather automatic time correction is performed while preserving the time difference and daylight saving time information.

The hardware configuration and functional configuration of an electronic timepiece 2 according to the second exemplary embodiment are the same as in the above-described electronic timepiece 1. The manual time correction processing, count processing, time connection processing, remote connection processing, remote connection communication processing and automatic time correction processing of the electronic timepiece 2 are also the same as in the electronic timepiece 1. Because the time correction communication processing and the automatic time correction processing differ from the electronic timepiece 1, these two processing will be described.

Figure 12:
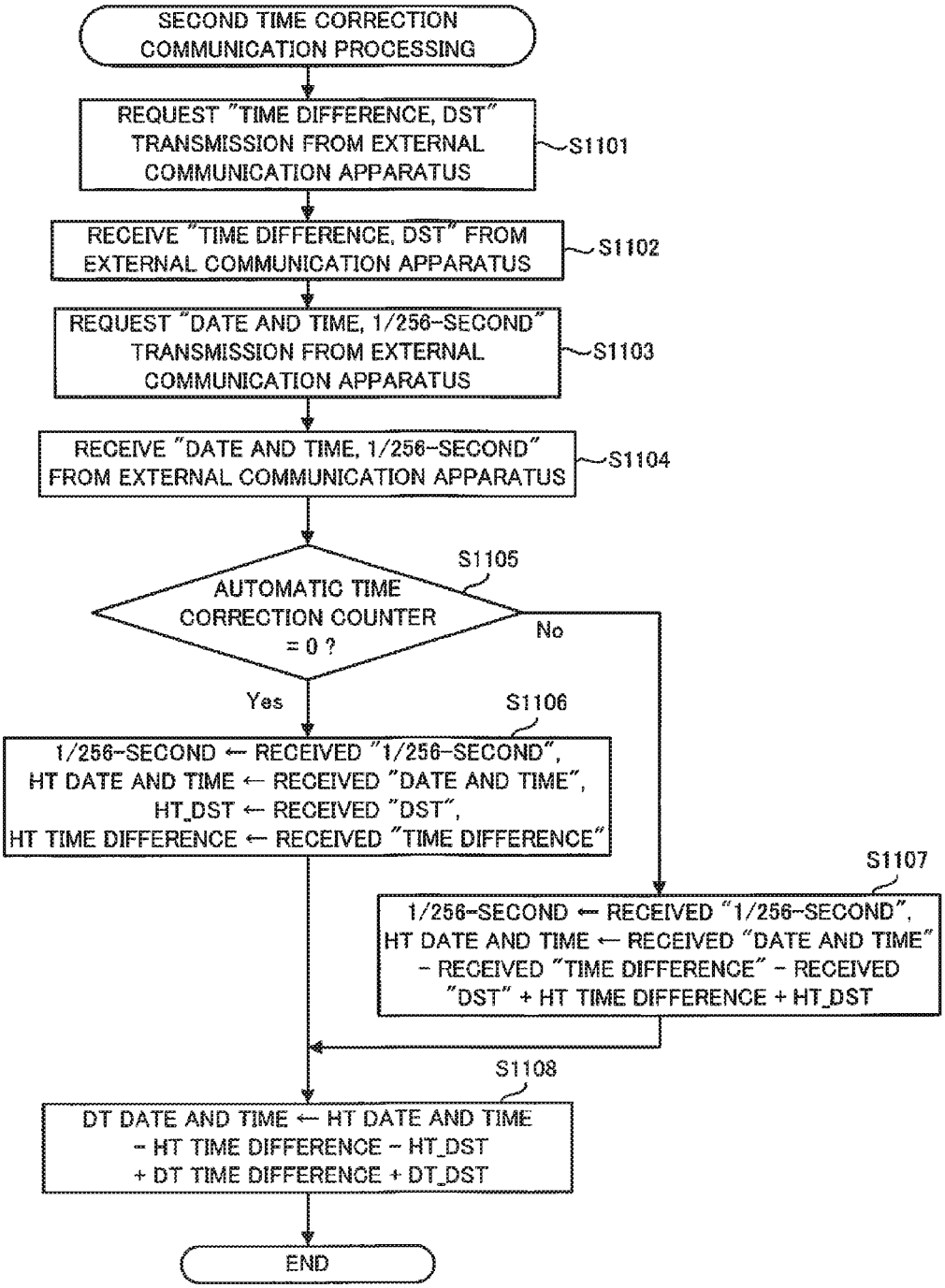
FIG. 12 is a flowchart of a time correction communication processing of the electronic timepiece 2 according to a second exemplary embodiment of the present disclosure.

First, a second time correction communication processing according to the electronic timepiece 2 will be described with reference to FIG. 12. Initially, the controller 210 requests transmission of time difference and daylight saving time information from an external communication apparatus, via the communicator 244 (step S1101). The external communication apparatus, upon receiving the request, transmits the time difference and daylight saving time information of the timepiece the apparatus possesses, to the requesting apparatus. Then, the controller 210 receives the time difference and daylight saving time information transmitted by the external communication apparatus, via the communicator 244 (step S1102).

Next, the controller 210 requests transmission of the date and time and 1/256-second information from the external communication apparatus, via the communicator 244 (step S1103). The external communication apparatus, upon receiving the request, transmits the date and time and 1/256-second information of the timepiece the apparatus possesses, to the requesting apparatus. Then, the controller 210 receives the date and time and 1/256-second information transmitted by the external communication apparatus, via the communicator 244 (step S1104).

Next, time correction processing changer 213 determines whether or not the automatic time correction counter 229 is 0 (step S1105). If the automatic time correction counter 229 is 0 (step S1105: Yes), the controller 210 sets the received 1/256-second information in the 1/256-second memory 227, sets the received date and time in the HT date and time memory 223, sets the received daylight saving time information in the HT_DST memory 222, and sets the received time difference information in the HT time difference memory 221 (step S1106), and proceeds to step S1108.

If the automatic time correction counter 229 is not 0 (step S1105: No), the controller 210 sets the received 1/256-second information in the 1/256-second memory 227, and sets in the HT date and time memory 223 a value found by subtracting the received time difference and daylight saving time information from the received date and time and adding the time difference stored in the HT time difference memory 221 and the daylight saving time information stored in the HT_DST memory 222 (step S1107). Then, the processing proceeds to step S1108.

In step S1108, the controller 210 finds the dual time date and time by adding to the Coordinated Universal Time (UTC), calculated by subtracting from the home time date and time stored in the HT date and time memory 223 the time difference stored in the HT time difference memory 221 and the daylight saving time information stored in the HT_DST memory 222, the time difference stored in the DT time difference memory 224 and the daylight saving time stored in the DT_DST memory 225, and sets the result in the DT date and time memory 226 (step S1108). Then, the processing concludes.

A supplementary description of the calculation contents of step S1107 is as follows. First, Coordinated Universal Time (UTC) is calculated by subtracting the received time difference and daylight saving time information from the received date and time. Next, the time difference and daylight saving time information stored in the electronic timepiece 2 is added to the calculated Coordinated Universal Time (UTC), and through this the minutes, seconds and 1/256-second information of Coordinated Universal Time (UTC) is set in the electronic timepiece 2 without changing the time difference and daylight saving time information of the electronic timepiece 2.

Figure 13:
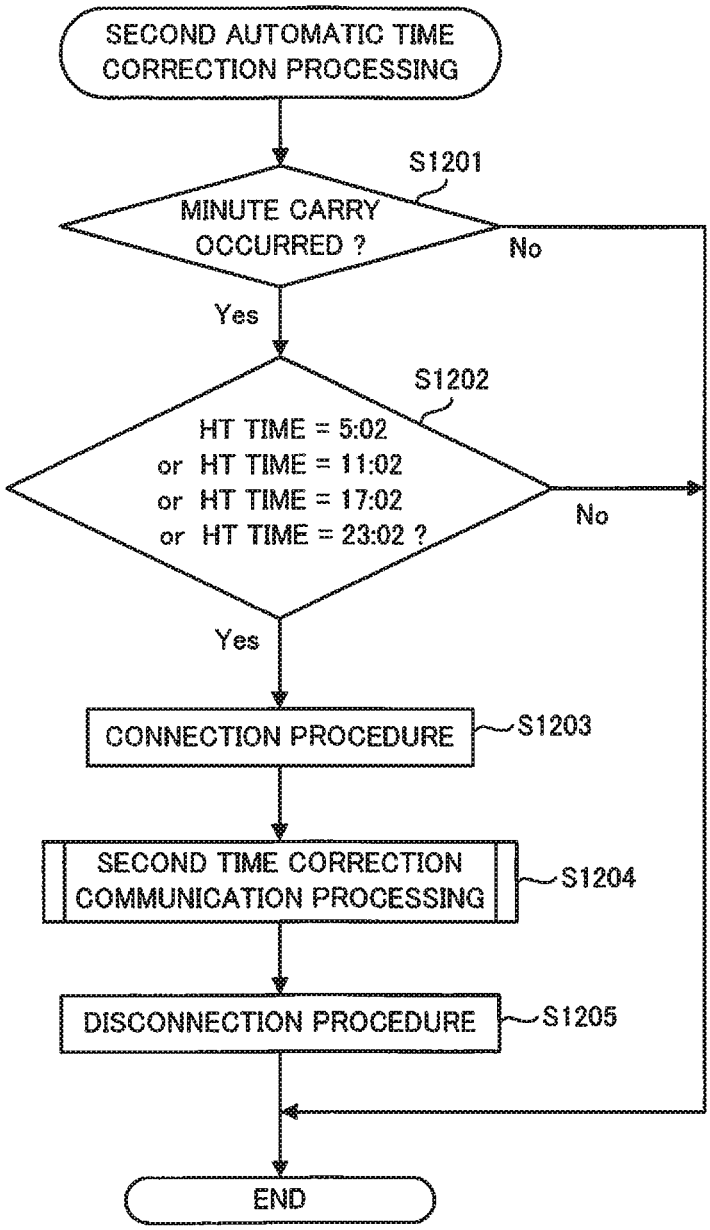
FIG. 13 is a flowchart of an automatic time correction processing of the electronic timepiece 2 according to the second exemplary embodiment.

Next, a second automatic time correction processing according to the electronic timepiece 2 will be described with reference to FIG. 13.

First, the automatic time corrector 211 determines whether or not a minute carry (carrying of a minute that occurs one second after 59 seconds each minute) has occurred (step S1201). If the minute carry has occurred (step S1201: Yes), the automatic time corrector 211 determines whether or not the time (hours and minutes) of the home time stored in the HT date and time memory 223 is 5:02, 11;02, 17:02 or 23:02 (step S1202).

If the time is any of these times (step S1202: Yes), the automatic time corrector 211 executes a connection procedure to an external communication apparatus, via the communicator 244 (step S1203). Then, the above-described second time correction communication processing is executed (step S1204), and following this, the automatic time corrector 211 executes a disconnection procedure to the external communication apparatus, via the communicator 244 (step S1205) and concludes the processing.

When the minute carry has not occurred (step S1201: No), and when the time (hours and minutes) of the home time stored in the HT date and time memory 223 is not 5:02, 11:02, 17:02 or 23:02 (step S1202: No), the processing concludes with nothing being done.

Through this processing, the time of the electronic timepiece 2 is periodically corrected to the time of the external communication apparatus, but through the second time correction communication processing, the time difference and daylight saving time information are preserved while the automatic time correction counter 229 is not 0. Accordingly, after the time of the electronic timepiece 2 is manually corrected, for 24 hours, even if automatic time correction is performed, returning to the time of the departure location can be prevented. The ability to set the timing of the automatic time correction to an arbitrary timing (however, avoiding the timing of 00 minutes each hour) and the ability to set the interval during which the automatic time correction is not performed following manual correction of the time of the electronic timepiece 2 to an arbitrary interval and not 24 hours, are the same as in the case of the electronic timepiece 1.

Third Exemplary Embodiment

In the above-described second exemplary embodiment, the electronic timepiece 2 is assumed to store the time difference and daylight saving time information, so in a timepiece that does not store the time difference and daylight saving time information, performing the same processing as in the second exemplary embodiment is not possible. However, even in a timepiece that does not store the time difference and daylight saving time information, if the seconds and 1/256-second information can be used out of the time information of the timepiece of the external communication apparatus, correction of a plurality of seconds fast or slow is possible. Hence, a third exemplary embodiment will be described in which information about seconds and less of the timepiece of an external communication apparatus is effectively utilized, even in a timepiece that does not store the time difference and daylight saving time information.

Figure 14:
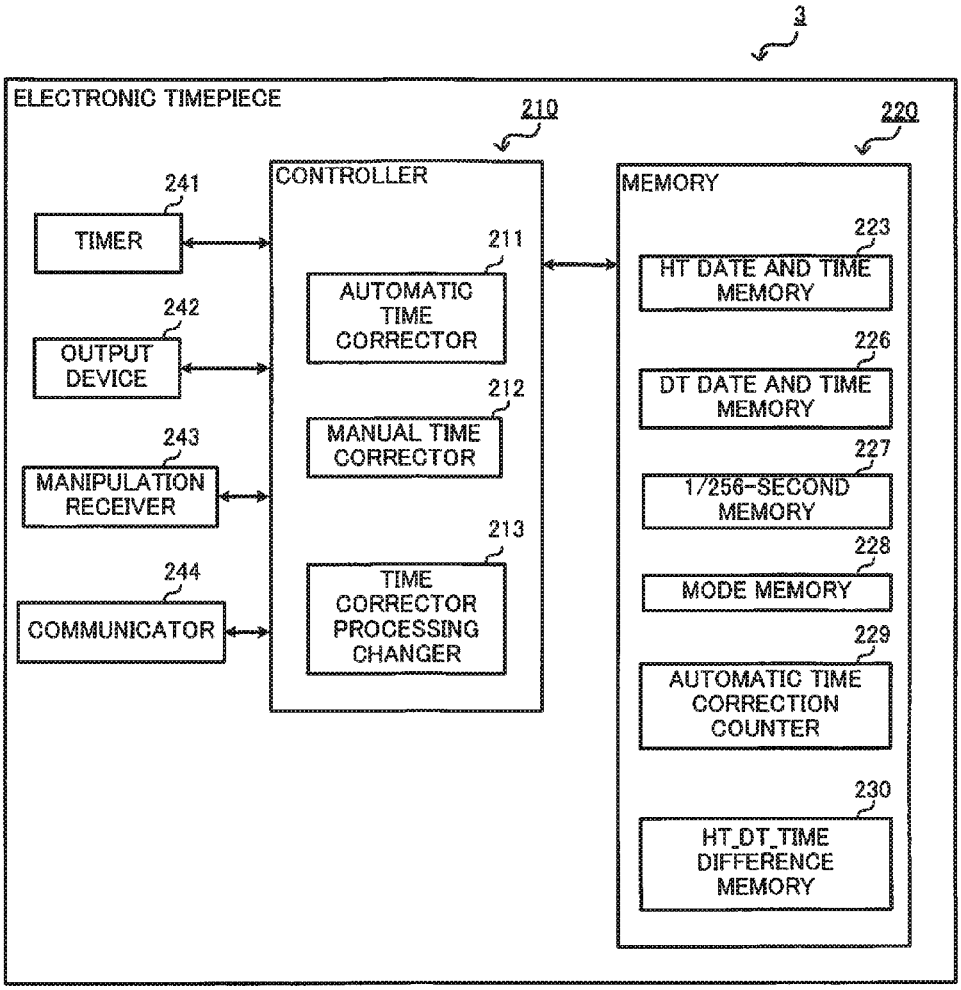
FIG. 14 is a block diagram showing a functional configuration of the electronic timepiece 3 according to a third exemplary embodiment of the present disclosure.

A hardware configuration of an electronic timepiece 3 according to the third exemplary embodiment is the same as in the above-described electronic timepieces 1 and 2. In addition, a functional configuration of the electronic timepiece 3 is as shown in FIG. 14, and in contrast to the functional configuration of the electronic timepieces 1 and 2, the HT time difference memory 221, the HT_DST memory 222, the DT time difference memory 224 and the DT_DST memory 225 are removed from the memory 220, and an HT_DT time difference memory 230 is added. The manual time correction processing, count processing, time connection processing, remote connection processing, remote connection communication processing, and automatic time correction processing of the electronic timepiece 3 are basically the same as in the electronic timepieces 1 and 2, but because the time difference and the daylight saving time information are not stored, processing related to such are omitted. In addition, the automatic time correction processing of the electronic timepiece 3 is the same as the second automatic time correction processing according to the electronic timepiece 2, but the second time correction communication processing executed in step S1204 becomes the below-described third time correction communication processing.

Figure 15:
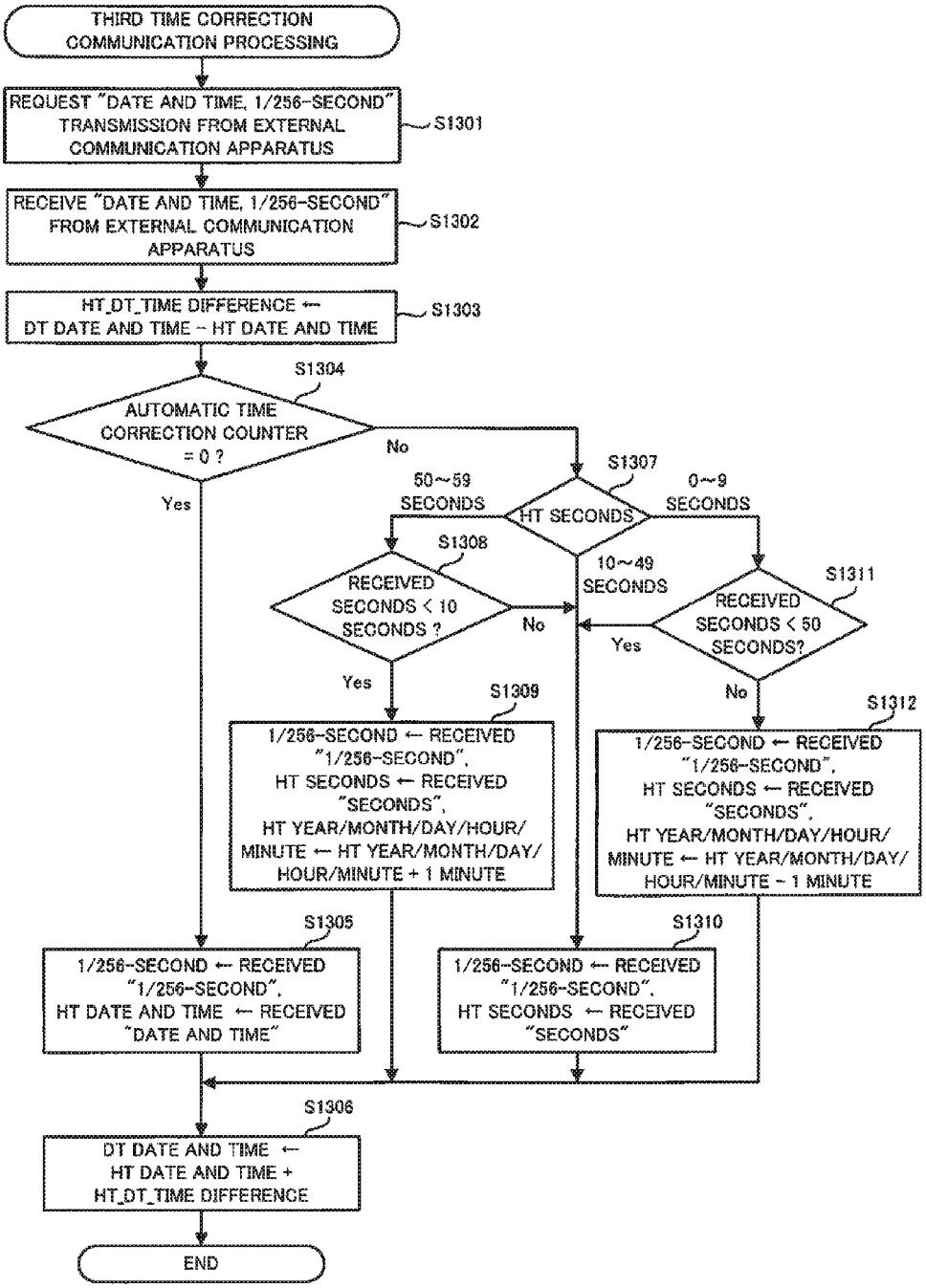
FIG. 15 is a flowchart of a time correction communication processing of the electronic timepiece 3 according to the third exemplary embodiment.

The time correction communication processing differs from both the electronic timepiece 1 and the electronic timepiece 2, so the third time correction communication processing according to the electronic timepiece 3 is described below with reference to FIG. 15.

First, the controller 210 requests transmission of the date and time and 1/256-second information from the external communication apparatus, via the communicator 244 (step S1301). The external communication apparatus, upon receiving the request, transmits the date and time and 1/256-second information of the timepiece the apparatus possesses, to the requesting apparatus. Then, the controller 210 receives the date and time and 1/256-second information transmitted by the external communication apparatus, via the communicator 244 (step S1302).

Next, the controller 210 sets in the HT_DT time difference memory 230 a value found by subtracting from the dual time date and time information stored in the DT date and time memory 226 the home time date and time information stored in the HT date and time memory 223 (step S1303).

Next, the time correction processing changer 213 determines whether or not the automatic time correction counter 229 is 0 (step S1304). If the automatic time correction counter 229 is 0 (step S1304: Yes), the controller 210 sets the received 1/256-second information in the 1/256-second memory 227, sets the received date and time information in the HT date and time memory 223 (step S1305) and proceeds to step S1306.

If the automatic time correction counter 229 is not 0 (step S1304: No), the controller 210 determines in which out of the ranges "50-59 seconds", "10-49 seconds" or "0-9 seconds" the seconds value of the home time stored in the HT date and time memory 223 (hereafter, denoted as "HT seconds") is (step S1307). If the HT seconds is in the range "50-59 seconds" (step S1307: 50-59 seconds), the controller 210 determines whether or not the seconds value in the received date and time information (hereafter denoted as "received seconds") is less than 10 (step S1308).

If the received seconds is less than 10 (step S1308: Yes), the controller 210 sets the 1/256-second memory 227 to the received 1/256-second information, sets the seconds of the HT date and time memory 223 to the received seconds, and out of the date and time information stored in the HT date and time memory 223, sets a value found by adding one minute to the values of a minute or more as the values of the minute or more of the date and time information stored in the HT date and time memory 223 (step S1309). Then, the processing proceeds to step S1306.

If the received seconds is 10 or more (step S1308: No), the controller 210 sets the 1/256-second memory 227 to the received 1/256-second information and sets the seconds value of the HT date and time memory 223 to the received seconds (step S1310), and proceeds to step S1306.

If the HT seconds is in the range "10-49 seconds" (step S1307: 10-49 seconds), the controller 210 sets the 1/256-second memory 227 to the received 1/256-second information and sets the value of the seconds in the HT date and time memory 223 to the received seconds (step S1310), and proceeds to step S1306.

If the HT seconds is in the range "0-9 seconds" (step S1307: 0-9 seconds), the controller 210 determines whether or not the received seconds is less than 50 (step S1311). If the received seconds is less than 50 (step S1311: Yes), the controller 210 sets the 1/256-second memory 227 to the received 1/256-second information and sets the value of the seconds in the HT date and time memory 223 to the received seconds (step S1310), and proceeds to step S1306.

If the received seconds is 50 or more (step S1311: No), the controller 210 sets the 1/256-second memory 227 to the received 1/256-second information, sets the value of the seconds in the HT date and time memory 223 to the received seconds, and sets values from minutes up out of the date and time information stored in the HT date and time memory 223 to values of minutes up reduced by one minute, out of the date and time information stored in the HT date and time memory 223 (step S1312). Then, the processing proceeds to step S1306.

In step S1306, the controller 210 adds the value stored in the HT_DT time difference memory 230 to the home time date and time stored in the HT date and time memory 223 to find the dual time date and time, and sets the DT date and time memory 226 to this value (step S1306). Then, the processing concludes.

Through the third time correction communication processing above, in an electronic timepiece 3 not possessing time difference and daylight saving time information, time correction of time slow or fast by less than 10 seconds is possible on the basis of the time of an external communication apparatus.

Figure 16:
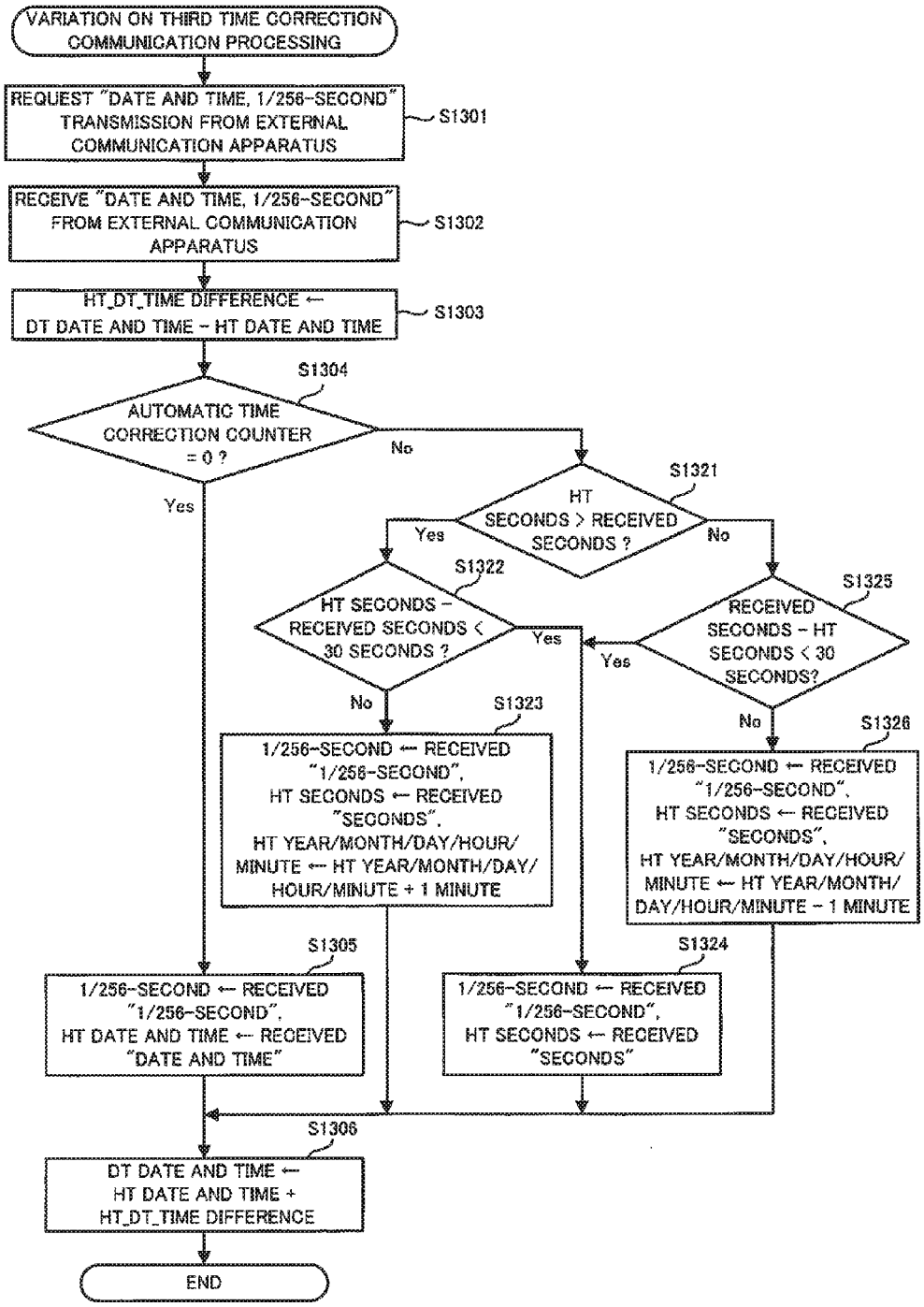
FIG. 16 is a flowchart of a variation of the time correction communication processing of the electronic timepiece 3 according to the third exemplary embodiment.

Next, a variation of the third time correction communication processing with which time correction is similarly possible if the electronic timepiece 3 is fast or slow by less than 30 seconds will be described with reference to FIG. 16. Contrasting this variation to the third time correction communication processing, only the processing after a determination of No in step S1304 differs, so this part will be described. The processing other than this is the same as the third time correction communication processing.

When a determination is made by the time correction processing changer 213 that the automatic time correction counter 229 is not 0 (step S1304: No), the controller 210 determines whether or not the HT seconds is larger than the received seconds (step S1321). When the HT seconds is larger than the received seconds (step S1321: Yes), the controller 210 determines whether or not HT seconds minus received seconds is less than 30 seconds (step S1322). If this value is less than 30 seconds (step S1322: Yes), the controller 210 sets the 1/256-second memory 227 to the received 1/256-second information and sets the seconds value in the HT date and time memory 223 to the received seconds (step S1324), and proceeds to step S1306.

If HT seconds minus received seconds is 30 seconds or more (step S1322: No), the controller 210 sets the 1/256-second memory 227 to the received 1/256-second information, sets the seconds value in the HT date and time memory 223 to the received seconds and sets the values for minutes and up out of the date and time information stored in the HT date and time memory 223 to a value of the values for minutes and up plus one minute, out of the date and time information stored in the HT date and time memory 223 (step S1323). The processing then proceeds to step S1306.

If the HT seconds is not greater than the received seconds (step S1321: No), the controller 210 determines whether or not received seconds minus HT seconds is less than 30 seconds (step S1325). If this value is less than 30 seconds (step S1325: Yes), the controller 210 sets the 1/256-second memory 227 to the received 1/256-second information and sets the seconds value in the HT date and time memory 223 to the received seconds (step S1324), and proceeds to step S1306.

If received seconds minus HT seconds is 30 seconds or more (step S1325: No), the controller 210 sets the 1/256-second memory 227 to the received 1/256-second information, sets the seconds value in the HT date and time memory 223 to the received seconds and sets the values for minutes and up out of the date and time information stored in the HT date and time memory 223 to a value of the values for minutes and up minus one minute, out of the date and time information stored in the HT date and time memory 223 (step S1326). The processing then proceeds to step S1306.

Through the above variation on the third time correction communication processing, time correction can be performed on the basis of the time of an external communication apparatus if the time is slow or fast by less than 30 seconds, even in the electronic timepiece 3 not possessing time difference or daylight saving time information.

The various functions of the electronic timepieces 1, 2, 3 of the present disclosure can be implemented by a computer such as a typical personal computer (PC) and/or the like. Specifically, in the above-described exemplary embodiments, the description was for a case in which programs for the various processing performed by the electronic timepieces 1, 2, 3 were stored in advance in the ROM 102 of the memory 220. However, a computer may also be configured such that the programs are stored and distributed on a computer-readable recording medium such as a flexible disk, a compact disc read only memory (CD-ROM), a digital versatile disc (DVD), a magneto-optical disc (MO) and/or the like, and the various above-described functions are realized by reading and installing these programs on a computer.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A communication apparatus comprising:

a communicator that receives a standard time from an external apparatus;

a manipulation receiver that receives a time correction action from a user; and a controller that performs a timing processing for clocking time, and a time correction processing for correcting time clocked by the timing processing, on the basis of the standard time received by the communicator, or on the basis of the time correction action received by the manipulation receiver;

wherein the controller changes processing contents of the time correction processing until a prescribed time interval has elapsed, when the time clocked by the timing processing was corrected on the basis of the time correction action received by the manipulation receiver.

2. The communication apparatus according to claim 1, wherein the controller suppresses, until the prescribed time interval has elapsed, correction of time clocked by the timing processing on the basis of the standard time received by the communicator by the time correction processing.

3. The communication apparatus according to claim 1, wherein:

the communicator transmits notification information that is a signal for starting communication to the external apparatus; and the controller:

performs notification-information transmission control that causes the notification information to be transmitted to the communicator for a prescribed interval, and stops the notification-information transmission control until the prescribed time interval has elapsed, when the time clocked by the timing processing was corrected on the basis of the time correction action.

4. The communication apparatus according to claim 2, wherein:

the communicator transmits notification information that is a signal for starting communication to the external apparatus; and the controller:

performs notification-information transmission control that causes the notification information to be transmitted to the communicator for a prescribed interval, and stops the notification-information transmission control until the prescribed time interval has elapsed, when the time clocked by the timing processing was corrected on the basis of the time correction action.

5. The communication apparatus according to claim 1, wherein the controller does time correction in units of seconds or less until the prescribed time interval has elapsed.

6. The communication apparatus according to claim 2, wherein the controller does time correction in units of seconds or less until the prescribed time interval has elapsed.

7. The communication apparatus according to claim 3, wherein the controller does time correction in units of seconds or less until the prescribed time interval has elapsed.

8. The communication apparatus according to claim 4, wherein the controller does time correction in units of seconds or less until the prescribed time interval has elapsed.

9. The communication apparatus according to claim 1, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

10. The communication apparatus according to claim 2, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

11. The communication apparatus according to claim 3, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

12. The communication apparatus according to claim 4, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

13. The communication apparatus according to claim 5, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

14. The communication apparatus according to claim 6, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

15. The communication apparatus according to claim 7, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

16. The communication apparatus according to claim 8, further comprising a memory that stores time difference information indicating a time difference from Coordinated Universal Time, and daylight saving time information that is information related to implementation of daylight saving time;

wherein the controller does not change the time difference information and the daylight saving time information stored in the memory until the prescribed time interval has elapsed.

17. An electronic timepiece comprising:

a display that displays time clocked by the controller; and the communication apparatus according to claim 1.

18. An electronic timepiece comprising:

a display that displays time clocked by the controller; and the communication apparatus according to claim 2.

19. A communication method including:

a timing step that clocks time, a receiving step that receives a standard time from an external apparatus;

a manipulation receiving step that receives a time correction action from a user;

a time correction step that performs a time correction processing for correcting time clocked in the timing step, on the basis of the standard time received in the receiving step, or on the basis of the time correction action received in the manipulation receiving step; and an automatic time correction processing changing step that corrects processing contents of a time correction processing by the time correction step until a prescribed time interval has elapsed, when the time clocked in the timing step was corrected on the basis of the time correction action received in the manipulation receiving step.

20. A recording medium on which are stored programs that cause a computer to execute:

a timing step that clocks time, a receiving step that receives a standard time from an external apparatus;

a manipulation receiving step that receives a time correction action from a user;

a time correction step that performs a time correction processing for correcting time clocked in the timing step, on the basis of the standard time received in the receiving step, or on the basis of the time correction action received in the manipulation receiving step; and an automatic time correction processing changing step that corrects processing contents of a time correction processing by the time correction step until a prescribed time interval has elapsed, when the time clocked in the timing step was corrected on the basis of the time correction action received in the manipulation receiving step.

* * * * *